US005631727A

United States Patent [19]

Ehara et al.

[11] Patent Number: 5,631,727

[45] Date of Patent: May 20, 1997

[54] IMAGE FORMING APPARATUS HAVING DISCHARGING MEANS USING LIGHT SOURCE ACTUATED PRIOR TO LATENT IMAGE FORMATION

[75] Inventors: Toshiyuki Ehara; Koji Yamazaki; Shigenori Ueda; Hitoshi Murayama, all of Nagahama, Japan

[73] Assignee: Canon Kabushiki Kaisha, Tokyo, Japan

[21] Appl. No.: 210,413

[22] Filed: Mar. 18, 1994

Related U.S. Application Data

[63] Continuation of Ser. No. 875,338, Apr. 29, 1992, abandoned.

[30] Foreign Application Priority Data

Apr. 30, 1991 [JP] Japan ..... 3-128371
Apr. 30, 1991 [JP] Japan ..... 3-128372

[51] Int. Cl.[6] ..... G03G 15/02

[52] U.S. Cl. ..... 355/219

[58] Field of Search ..... 355/208, 218, 355/203, 204, 209, 279

[56] References Cited

U.S. PATENT DOCUMENTS

| | | | |
|---|---|---|---|
| 3,792,494 | 2/1974 | Matkan et al. | 355/208 X |
| 4,272,183 | 6/1981 | Maese | 355/208 X |
| 4,365,885 | 12/1982 | Nishikawa | 355/218 |
| 4,477,179 | 10/1984 | Inuzuka et al. | 355/69 X |
| 4,538,902 | 9/1985 | Inuzuka et al. | 219/216 X |
| 4,737,748 | 4/1988 | Ito | 355/218 |
| 4,800,442 | 1/1989 | Riseman et al. | 358/280 |
| 4,806,976 | 2/1989 | Kato et al. | 355/218 |
| 4,841,328 | 6/1989 | Tekeuchi et al. | 355/211 |
| 4,864,364 | 9/1989 | Ogino et al. | 355/202 |
| 4,935,777 | 6/1990 | Noguchi et al. | 355/210 |
| 5,016,052 | 5/1991 | Sambayashi et al. | 355/228 |
| 5,087,543 | 2/1992 | Narita et al. | 430/66 |
| 5,089,847 | 2/1992 | Folkins | 355/202 |
| 5,164,779 | 11/1992 | Araya et al. | 355/219 |

FOREIGN PATENT DOCUMENTS

| | | |
|---|---|---|
| 60-169884 | 9/1985 | Japan . |
| 62-39972 | 2/1987 | Japan . |
| 2-10393 | 2/1990 | Japan . |

*Primary Examiner*—William J. Royer
*Attorney, Agent, or Firm*—Fitzpatrick, Cella, Harper & Scinto

[57] ABSTRACT

An image forming apparatus includes an electrophotographic photosensitive member movable along an endless path; a charger for charging the photosensitive member; an optical device for projecting light information on the photosensitive member to form an electrostatic latent image; and a optical charge removing device for removing residual electric charge from the photosensitive member, the charge removing device having a light source disposed upstream of the charging device with respect to a movement direction of the photosensitive member and being operated in accordance with time-modulated signal prior to latent image formation.

12 Claims, 7 Drawing Sheets

IMAGE FORMING APPARATUS HAVING DISCHARGING MEANS USING LIGHT SOURCE ACTUATED PRIOR TO LATENT IMAGE FORMATION

This application is a continuation of application Ser. No. 07/875,338 filed Apr. 29, 1992, now abandoned.

FIELD OF THE INVENTION AND RELATED ART

The present invention relates to an electrophotographic apparatus, for example, to an electrophotographic apparatus using an amorphous silicon photosensitive member.

In electrophotographic machines, selenium (Se), organic photoconductor (OPC), amorphous silicon or the like photosensitive members are used with the respective advantages being particularly used.

The amorphous silicon photosensitive member is characterized by a high surface hardness, a high sensitivity to long wavelength light such as semiconductor laser beams (770 nm–800 nm), and substantially no deterioration with repeated use. Because of these characteristics, the amorphous silicon photosensitive members are widely used as electrophotographic photosensitive members for high speed copying machines and LBP's (laser beam printers).

The OPC photosensitive members are characterized by easy production of large area photosensitive members because of the easiness of uniform film formation, and easiness in massproduction with low cost. Because of the characteristics, OPC photosensitive members are used as electrophotographic photosensitive members for large sheet size copying machines, personal use copying machines, small size laser beam printers and or the like.

The selenium photosensitive member is characterized by the sensitivity to the wavelength range of the semiconductor laser beam (770 nm–800 nm) if tellurium is added. Therefore, it is widely used for electrophotographic photosensitive members in middle speed copying machines and laser beam printers.

Referring first to FIG. 1, there is shown an example of a conventional electrophotographic machine in the form of a copying machine. In this embodiment, the amorphous silicon photosensitive member 101 in the form of a drum rotates in the direction indicated by an arrow X. As is well known, around the photosensitive member 101, there are disposed a primary charger 102, an electrostatic latent image forming station 103, a developing device 104, a transfer sheet supply system 110, transfer/separation chargers 112, a cleaner 105, a sheet conveying system 113, a charge removing light source 106, or the like. The photosensitive member 101 is uniformly charged by the primary charger 102. An original to be copied 117 on a platen glass 118 is illuminated with the light emitted from a light source 114 in the form of a halogen lamp, fluorescent lamp or the like. The light reflected by the original 117 is projected onto the uniformly charged photosensitive member 101 by way of a mirror system 119, a lens system 116 and a filter 115, so that an electrostatic latent image is formed on the photosensitive member 101. The latent image is developed into a toner image with the toner supplied from the developing device 104.

On the other hand, a transfer material P is supplied to the photosensitive member 101 through the transfer material supply system including the transfer material passage 111 and registration rollers 109. Between the transfer charger 112 and the photosensitive member 101, the transfer material receives at its back side an electric field of the polarity opposite from that of the toner charge, by which the toner image is transferred from the surface of the photosensitive member 101 onto the transfer material P.

The separated transfer material P is conveyed by the transfer material conveying system 113 to an image fixing device (not shown), where the toner image is fixed. Finally, the transfer material is discharged to outside of the apparatus.

The residual toner remaining on the surface of the photosensitive member not transferred at the transfer station, is removed from the photosensitive member by the cleaner 105 including the cleaning blade 107.

The photosensitive member 101 cleaned by the cleaning device is subjected to the charge removing light from the main charge removing light source 106, and then is used for the next image forming process.

The diameter of the photosensitive member is 80–120 mm. With such a small diameter photosensitive member used, various parts therearound are disposed quite tightly because of the large size of the charger resulting from the low charging property of amorphous silicon photosensitive member and because of the close arrangement of the developing device due to the relatively large dark decay. Further, in view of the demand for the increase of the copying speed, it becomes difficult to assure a long time or distance from the main charger to the main charge removing light application.

Particularly in the case of the main charge removing light, it is desired to use an LED array which is capable of strictly controlling the wavelength and light quantity, from the standpoint of light memory removal, the assured charging property and the reduction of the potential shift. Because of the difficulty of providing large space for the substrate, the LED array is usually disposed at a top portion between the charger 102 and the cleaner 104, as shown in the Figure.

What are discussed above apply to the selenium, OPC and other photosensitive members.

The main charge removing light source 102 is actuated through a usual DC actuation system, and the light quantity is adjusted by a resistance connected in series. Therefore, in the conventional apparatus, even if the wavelength and the light quantity of the main charge removing light is changed, the charging property and the potential shift are equivalent if the light memory level is equivalent.

Therefore, in some cases, it is not avoidable to reduce the main charge removing light amount and to accept a certain level of light memory such as ghost or the like. The mechanism of such a phenomenon will be described briefly, taking as an example the case of amorphous silicon photosensitive member.

In the case of the amorphous silicon photosensitive member, the mobility of photocarriers is reduced by being trapped at the local level, or by the probability of the recombination of the light generated carriers. Therefore, in the image forming process, a part of the carriers generated by the exposure to the light is released from the local level simultaneously with the electric field application to the photosensitive member during the next charging step, so that a difference in the photosensitive member surface potential is produced between the exposed portion and the non-exposed portion. This finally appears as non-uniformity in the image, resulting from the light memory.

In order to avoid the light memory, the general method is to expose the photosensitive member to uniform light in the main charge removing step to increase the amount of carriers which potentially exist in the photosensitive member, so that the uniformity is established over the whole surface. It is possible to further effectively remove the ghost by increasing the quantity of light of the main charge removing light, or by making the wavelength of the main charge removing light closer to the spectrum sensitivity peak (generally 680 nm–700 nm) of the amorphous silicon photosensitive member.

However, if the main charge removing light is too intense, or when the wavelength is increased to approach the spectrum sensitivity peak, with the result of the increased probability of the photocarrier generation at a deep position of the photosensitive member, then the ratio of the remaining carriers increases. Then, the photosensitive member is brought to the main charging step before the over existing carriers potentially existing in the photosensitive member, are recombined. If this occurs, the charging property is remarkably deteriorated. In the charging step, there is a carrier recombining step at the initial stage therein, and only thereafter, is the surface potential increased. For this reason, the amount of carriers in the photosensitive member immediately before the charging step is significantly influential on the level of the surface potential thereafter, that is, the charging property of the photosensitive member. On the other hand, when the image forming process operation is repeated continuously under the same conditions, the potential shift phenomenon (the potential at the developing device gradually changes) is worsened, with the result of instable image density during the copy operation.

Accordingly, as for the main charge removing light, it is desirable that the quantity of light is small, and the wavelength is short under the condition that the light memory can be removed, so that the charging step is carried out after the carriers are substantially recombined.

However, when the parameters of the main charge removing light (light quantity, wavelength) are changed, and the degree of the light memory is equivalent, there is a tendency that the charging property and the potential shift are the same. Therefore, conventionally, under the limitation of the charging property, that is, the limitation of assured dark potential, a certain degree of ghost has to be accepted.

The amorphous silicon photosensitive member used in the electrophotographic machines described above, exhibits a high sensitivity to the long wavelength (the sensitivity peak is approximately 680 nm, and the sensitive region ranges from 400 nm to 800 nm). This is advantageous, and when the photosensitive member is used as the photosensitive member for the electrophotographic machine to copy usual documents or the like, the characters or letters are not collapsed or thinned,and there is no deterioration of the image quality. Therefore, it is sufficiently practical.

However, an even higher quality is desired. For example, when a very thin line such as smaller than 100 approximately, is reproduced, the line width is increased or reduced. As a more specific example, in the case of a rectangular image constituted by vertical lines at a 200 micron pitch and horizontal lines at a 150 micron pitch, the rectangular shape is collapsed, or in the case of a line having a width not more than 100 microns, the line is thinned, although the reproduction is satisfactory in practical use.

Recently, the average particle size of insulating toner particles (developer) is reduced to 4.5–9.0 microns from the previously conventional 10–12 microns. By the use of such small particle size toner, the image quality is improved, so that high resolution images can be provided. On the other hand, as regards the tone reproducibility, the tone reproducibility of the latent image is significantly influential when the small particle size toner capable of faithfully developing the latent image, is used. However, the tone reproducibility of the latent image is not sufficiently improved. Therefore, improvement in the tone reproducibility with the high image quality is desired.

As is known, the tone reproducibility is determined by E-V linearity, which is the linearity of the light portion potential when the image exposure quantity of the photosensitive member is changed. The tone reproducibility is good if the linearity of the E-V curve is high.

SUMMARY OF THE INVENTION

Accordingly, it is a principal object of the present invention to provide an electrophotographic machine wherein the light memory removing performance of the main charge removing light for removing the ghost image is increased.

It is another object of the present invention to provide an electrophotographic machine in which the reduction of the charging property and the potential shift are minimized.

It is a further object of the present invention to provide an electrophotographic machine which is good in the total performance with the capability of providing high quality images.

It is a further object of the present invention to provide an electrophotographic machine having an improved E-V linearity.

It is a further object of the present invention to use the image developing property of the small particle size toner to the best advantages to provide a very high image quality.

According to an aspect of the present invention, there is provided an image forming apparatus, comprising: an electrophotographic photosensitive member movable along an endless path; charging means for charging said photosensitive member; optical means for projecting light information on said photosensitive member to form an electrostatic latent image; and optical charge removing means for removing residual electric charge from said photosensitive member, said charge removing means having a light source disposed upstream of said charging means with respect to a movement direction of said photosensitive member and being operated in accordance with time-modulated signal prior to latent image formation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

[EMBODIMENT 1]

An electrophotographic copying machine according to this invention will be described. First, the description will be made as to experiments.

Experiment 1

Figure 1:
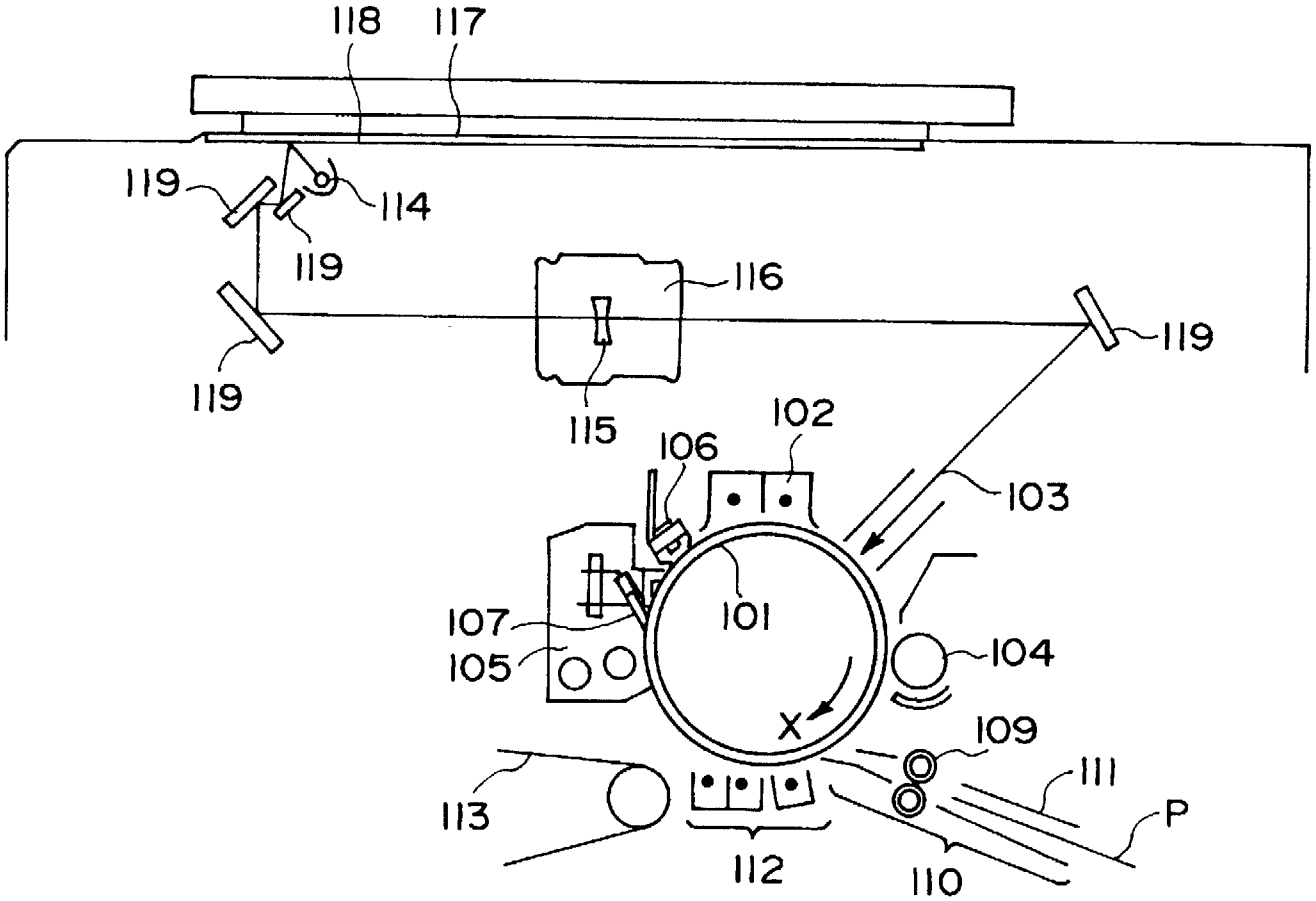
FIG. 1 is a sectional view of an electrophotographic apparatus according to an embodiment of the present invention.

The experiment was made with the electrophotographic machine shown in FIG. 1 and having an amorphous silicon photosensitive drum as the electrophotographic photosensitive member. The photosensitive member 101 was rotated at a surface peripheral speed of 380 mm/sec. The dependency of the light memory, the charging property and the potential shift on the main charge removing light wavelength were measured when the light quantity of the main charge removing light source 106 was maintained constant, while the wavelength was changed.

The light memory was measured in the following manner. First, the charging current of the main charger 102 was adjusted so that the dark potential of the photosensitive member at the developing position was 400 V, and the energization voltage for the original illuminating halogen lamp 114 was adjusted so that the light potential was +50 V when the original was a transfer sheet (A3 size) P. The potential difference at the same portion of the photosensitive member 101 between when the halogen lamp 114 was energized for only the leading portion of the image and when the halogen lamp 114 was not energized, that is, the potential difference at the image trailing portion was detected. The potential difference is taken as the light memory potential.

As for the charging property, the dark potential is detected at the developing device 104 position when the main charger 102 is supplied with a constant current.

As for the potential shift, the change of the dark potential at the developing device 104 position is measured when the main charger 102 is supplied with a constant current, and continuous copying operations are carried out.

Figure 2:
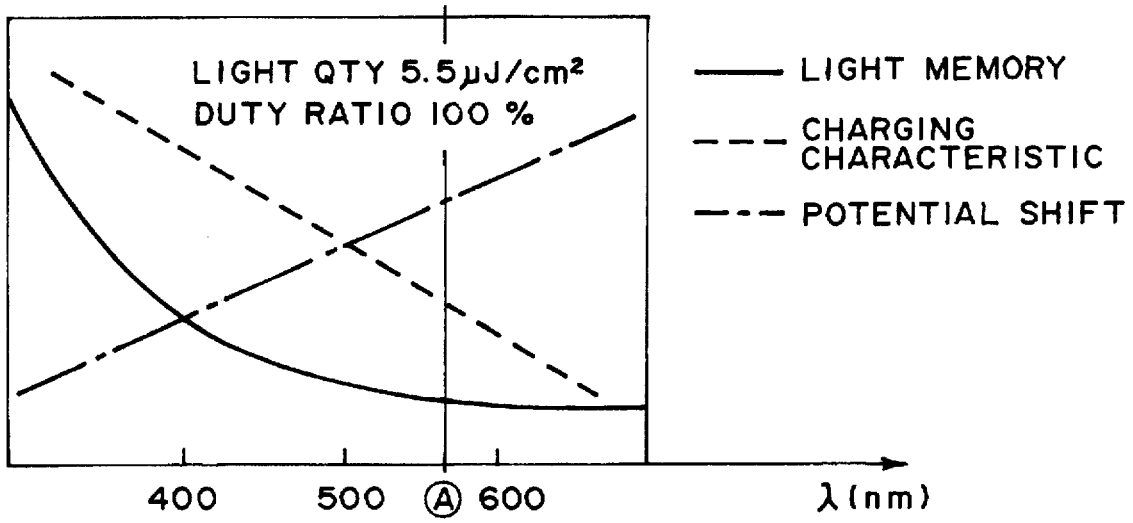
FIG. 2 is a graph showing dependency of the light memory, charging property and the potential shift on the wavelength of the main charge removing light.

FIG. 2 is a graph obtained as a result of the experiments. It will be understood that when the wavelength is increased with the constant quantity of light, the light memory decreases, but the charging property or the potential shift is worsened.

Experiment 2

The electrophotographic apparatus shown in FIG. 1 was used. The photosensitive member 101 was rotated at a peripheral speed of 380 m/sec. The wavelength of the main charge removing light source 106 light was maintained constant, but the light quantity was changed. The dependency of the light memory, the charging property and the potential shift on the light quantity of the main charge removing light, were measured.

The light memory, the charging property and the potential shift were determined in the same manner as in Experiment 1.

Figure 3:
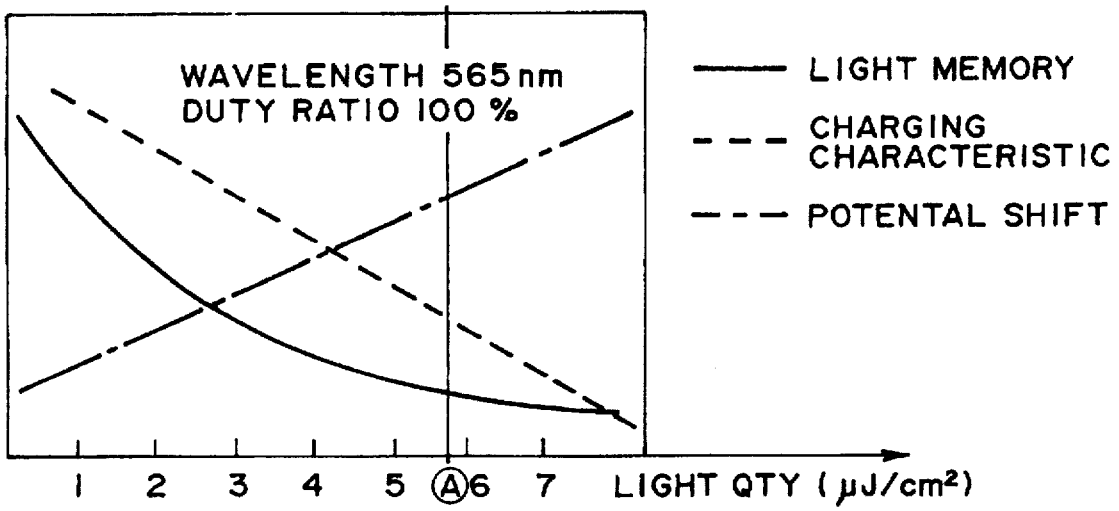
FIG. 3 is a graph showing the dependency of the light memory, charging property and the potential shift on the light quantity of the main charge removing light.

FIG. 3 is a graph obtained as a result of this experiment. It will be understood that when the quantity of light is increased with the constant wavelength, the light memory decreases, but the charging property and the potential shift are worsened.

Experiment 3

Figure 6:
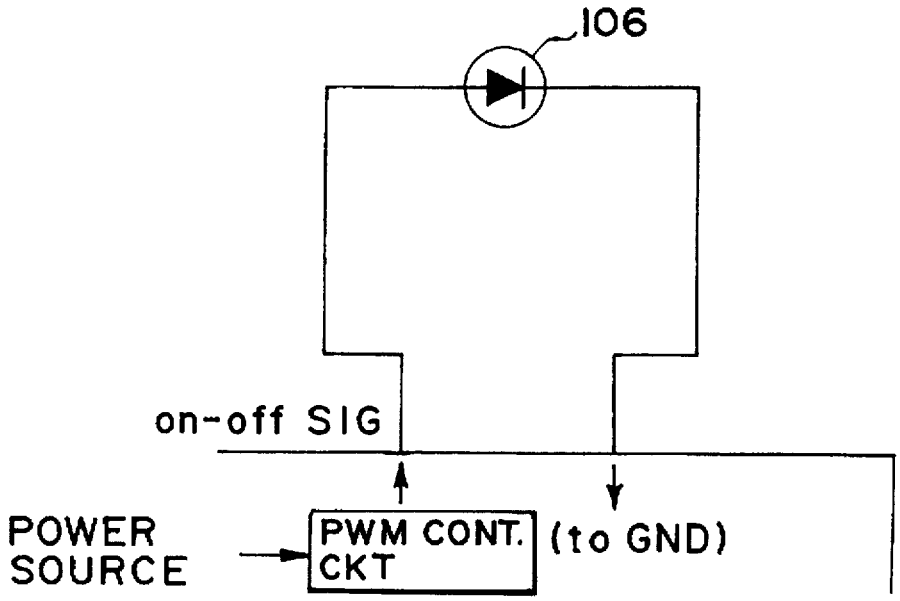
FIG. 6 is a circuit diagram of the main charge removing light source actuating system in accordance with the present invention.
Figure 7:
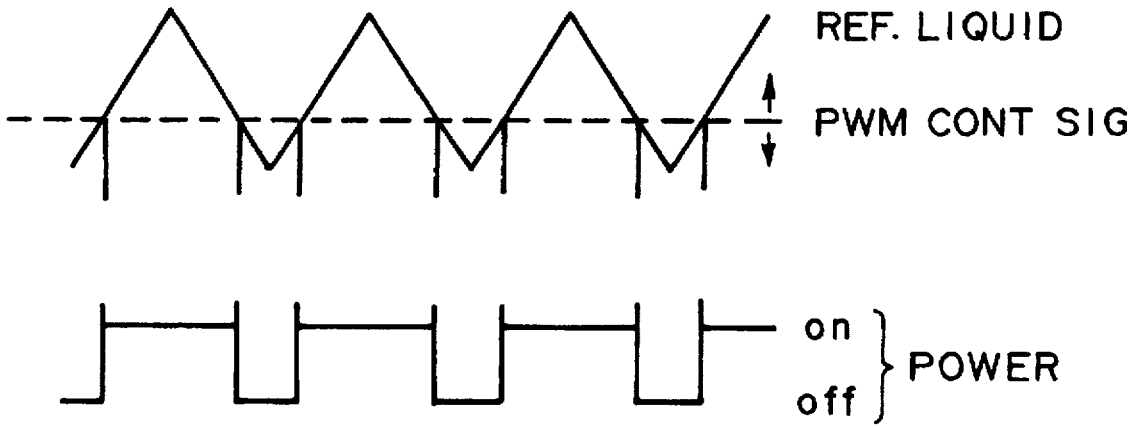
FIG. 7 shows the general idea of the pulse width modulation (PWM).

The electrophotographic machine shown in FIG. 1 was used. The photosensitive member 101 was rotated at a peripheral speed of 380 mm/sec. The actuation system for the main charge removing light source 106 was changed from the conventional DC actuation system (FIG. 8) to a pulse width modulation actuation system as shown in FIG. 6. The wavelength and the light quantity were maintained constant, whereas the duty ratio (the ratio of on-duration to one cycle duration, as shown in FIG. 7), was changed. The dependency of the light memory, the charging property and the potential shift on the duty ratio of the main charge removing light, were measured.

As for the pulse width modulation, a sawtooth reference wave as shown in FIG. 7 for example was used. The comparison was made between the reference wave and the control signal level, and the main charge removing light source 106 was ON-OFF-controlled in accordance with the results of comparison. In this experiment, the reference wave had 4 kHz frequency.

The light memory, the charging property and the potential shift were determined in the same manner as Experiment 1.

Figure 4:
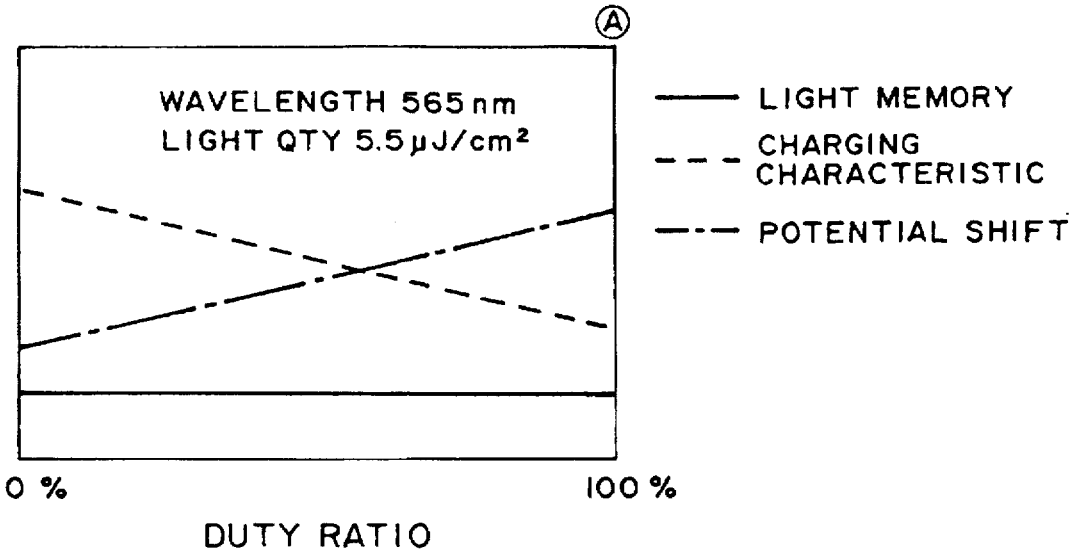
FIG. 4 is a graph showing the dependency of the light memory, charging property and the potential shift on the duty ratio of the main charge removing light.
Figure 5:
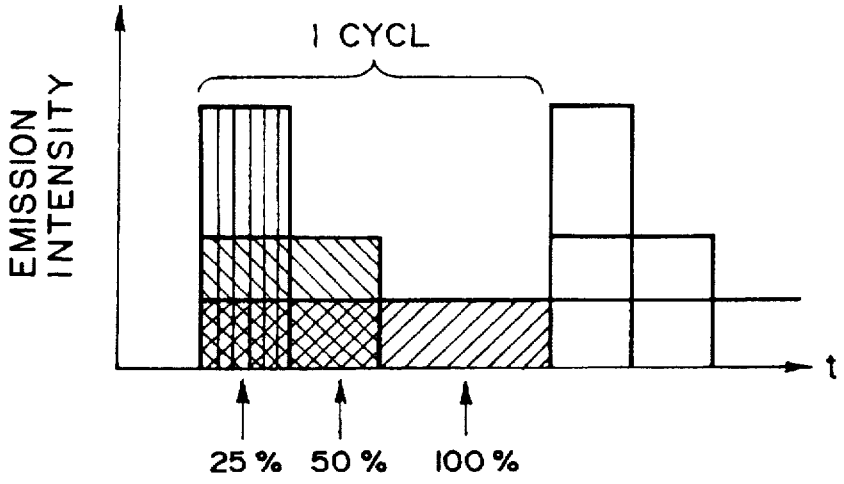
FIG. 5 shows the general idea of the duty ratio of the main charge removing device.

FIG. 5 shows a light emitting intensity when the duty ratio is changed. FIG. 4 is a graph obtained as a result of this experiment. From FIG. 4, it will be understood that when the duty ratio is reduced with the constant quantity of light and the constant wavelength, the light memory does not change, but the charging property and the potential shift become better.

Experiment 4

Figure 8:
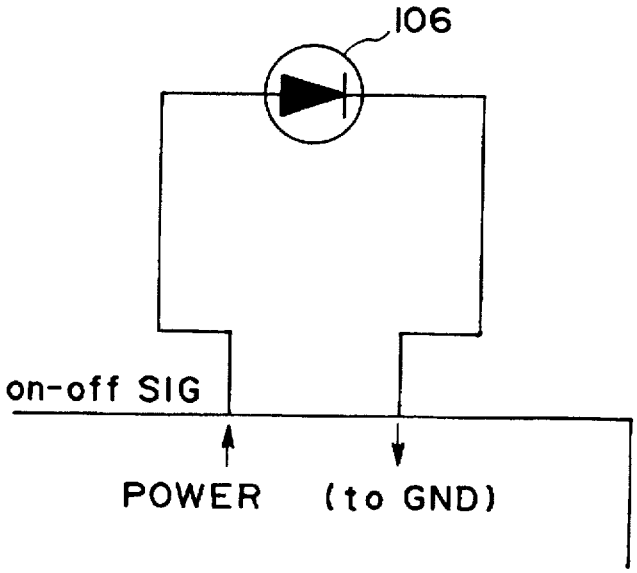
FIG. 8 is a circuit diagram of a conventional main charge removing light source actuating system.

The electrophotographic apparatus of FIG. 1 was used. The photosensitive member 101 was rotated at a peripheral speed of 380 mm/sec, and the main charge removing light source 106 was changed from the conventional DC actuating system as shown in FIG. 8 to a pulse width modulation actuating system as shown in FIG. 6. The wavelength and the quantity of light were maintained constant. The dependencies of the ratios of the light memory, the charging property and the potential shift between 100% duty ratio and 25% duty ratio, were measured with the frequency of the reference wave changed.

As for the pulse width modulation, the reference wave was in the form of saw teeth as shown in FIG. 7, for example. The control signal level was compared with the reference wave, and the main charge removing light source 106 was ON-OFF controlled in accordance with the result of the comparison.

The light memory, the charging property and the potential shift were determined in the same manner as in Experiment 1.

Figure 9:
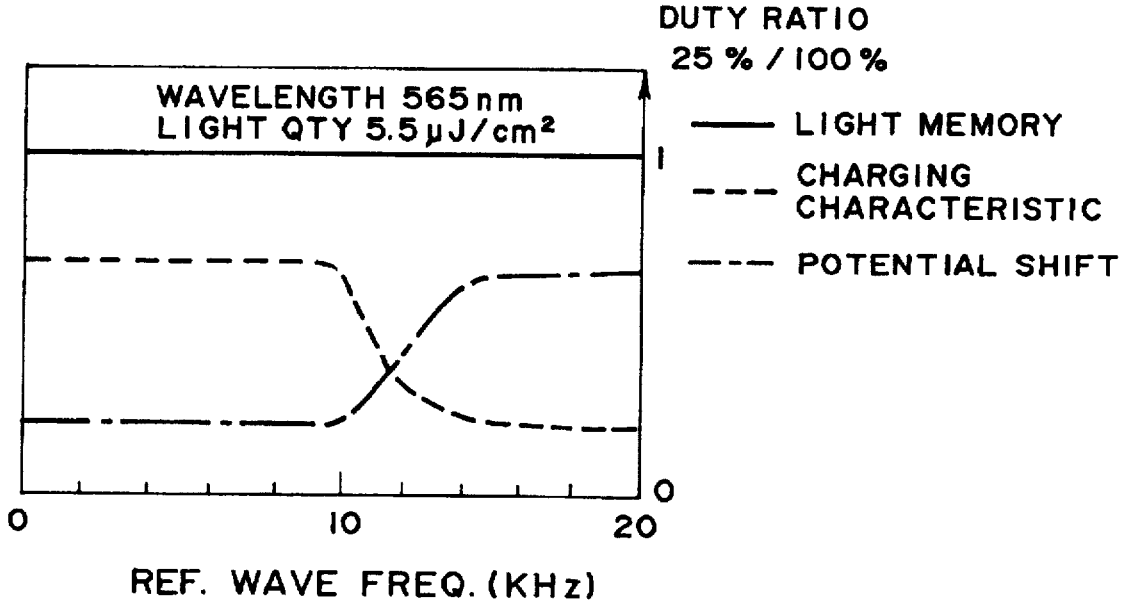
FIG. 9 shows plots of ratio of the light memory, charging property and the potential shift against the reference wave frequency when the duty ratio of the main charge removing light is 25% and 100%.

FIG. 9 is a graph obtained as a result of this experiment. It will be understood when the frequency of the reference wave is changed with constant quantity of light and constant wavelength, the light memory does not change, the frequency with which the charging property and the potential shift become better without change of light memory, involves an upper limit.

On the other hand, when the frequency is reduced, the light quantity non-uniformity of the main charge removing light in the photosensitive member 101 rotating direction, occurs when a value of the photosensitive member 101 rotating speed (mm/sec) divided by a frequency (/sec)

exceeds about 1 (mm). Therefore, the proper frequency involves a lower limit.

The dependencies of the light memory, the charging property and the potential shift on the light quantity and the wavelength of the main charge removing light, as understood on the basis of the Experiments 1 and 2, are crossed on a chain line A in FIGS. 2 and 3. In the other quantities of light and wavelengths, too, if one of the quantity of light and the wavelength is determined, the range of the other are automatically determined. Therefore, it can be said that the wave length range of the main charge removing light capable of satisfying the light memory, the charging property and the potential shift by adjusting the light quantity, is 500–700 nm.

It has been found that in the wavelength range, it is not possible to improve the charging property and the potential shift without changing the light memory.

From Experiment 3 using the pulse width modulation actuating system for the main charge removing light source 103, it has been found that by changing the duty ratio, the charging property and the potential shift can be improved without changing the light memory level.

From Experiment 4 using the pulse width modulation activating system for the main charge removing light source 106, it has been found in order to improve the charging property and the potential shift without changing the light memory level, the frequency of the reference wave is preferably not more than 10 kHz, and the value of the rotational speed (mm/sec) of the photosensitive member 101 divided by the frequency (/sec) of the reference wave is preferably not more than 1 mm.

Thus, it becomes possible to improve the charging property and the potential shift without deteriorating the conventional good level light memory and without changing the wavelength and the light quantity of the main charge removing light.

Now, the description will be made as to the embodiments of the present invention, but the present invention is not limited to the specific examples of these embodiments.

Embodiment 1

The electrophotographic machine shown in FIG. 1 was used. The photosensitive member 101 was rotated at a peripheral speed of 380 mm/sec. The main charge removing light source 106 was in the form of an LED providing the wavelength peak of 565 nm.

The energization of the main charge removing light source 106 was pulse width modulation type shown in FIG. 6. The duty ratio was 25%; the quantity of light was 5 μJ/cm$^2$. Under these conditions, the light memory, the charging property and the potential shift were measured.

In the pulse width modulation, the reference wave was in the form of a sawtooth wave shown in FIG. 7, for example. The comparison was made between the control signal level and the reference wave, and the main charge removing light source was ON-OFF controlled in accordance with the results of comparison. In this embodiment, the reference wave had a frequency of 4 kHz.

The light memory, the charging property and the potential shift were measured in the same manner as in Experiment 1.

The results of this embodiment are shown in the following Table 1. The charging property is improved, and the potential shift is reduced under the condition that the light memory is good.

TABLE 1

| | Wavelength (nm) | Light quantity (μJ/cm$^2$) | Duty ratio | Photo-memory | Charging property & potential shift | Total |
|---|---|---|---|---|---|---|
| Embodiment 1 | 565 | 5 | 25 | ○ | ◎ | ◎ |
| Embodiment 2 | 610 | " | " | ◎ | ○ | ◎ |
| Embodiment 3 | 565 | " | 50 | ○ | ○ | ○ |
| Embodiment 4 | " | 3 | 25 | Δ | ◎ | ○ |
| Comparison Example 1 | " | 5 | 100 | ○ | Δ | Δ |
| Comparison Example 2 | 610 | " | " | ◎ | x | Δ |

◎: Excellent
○: Good
Δ: Fair
x: No good

Comparison Example 1

The electrophotographic machine shown in FIG. 1 was used. The photosensitive member 101 was rotated at a peripheral speed of 380 mm/sec. The main charge removing light source 106 was in the form of an LED providing a wavelength peak of 565 nm.

The main charge removing light source 106 was actuated through a DC actuation system shown in FIG. 8. The light quantity was 5 μJ/cm$^2$. Under these conditions, the light memory, the charging property and the potential shift were measured.

The light memory, the charging property and the potential should were measured in the same manner as in Experiment 1.

The results are included in the Table 1 above. The light memory was equivalent to that of Embodiment 1, but the charging property, the potential shift were not improved.

Embodiment 2

The electrophotographic apparatus shown in FIG. 1 was used. The photosensitive member 101 was rotated at a peripheral speed of 380 mm/sec. The main charge removing light source 106 was in the form of an LED providing a wavelength peak of 610 nm. The actuation or energization of the main charge removing light source 106 was controlled through a pulse width modulation system as shown in FIG. 6. The duty ratio was 25%; and the quantity of light was 5 μJ/cm$^2$. Under these conditions, the light memory, the charging property and the potential shift were measured.

In this embodiment, the reference wave had a frequency of 4 kHz. The light memory, the charging property and the potential shift were measured in the same manner as in Experiment 1.

The results of Experiments are also included in Table 1. The charging property is improved, and the potential shift was reduced under the condition that the light memory is good.

Comparison Example 2

An electrophotographic apparatus shown in FIG. 1 was used. The photosensitive member 101 was rotated at a peripheral speed of 380 mm/sec. The main charge removing light source 105 had an LED providing a wavelength peak of 610 nm. The actuation of the main charge removing light source 106 was controlled through a DC control system shown in FIG. 8. The light quantity was 5 μJ/cm$^2$. Under these conditions, the light memory, the charging property and the potential shift were measured.

The light memory, the charging property and the potential shift were measured in the same manner as in Experiment 1.

The results of experiment are also included in Table 1. The light memory was equivalent to that of Embodiment 2, but the charging property and the potential shift were not improved.

Embodiment 3

The electrophotographic apparatus shown in FIG. 1 was used. The photosensitive member 101 was rotated at a peripheral speed of 380 mm/sec. The main charge removing light source 106 was in the form of an LED providing a wavelength peak of 565 nm.

The main charge removing light source 106 was controlled through a pulse width modulation control system shown in FIG. 6. The duty ratio was 50%; and the light quantity was 5 μJ/cm$^2$. Under these conditions, the light memory, the charging property and the potential shift were measured.

In this embodiment, the reference wave had a frequency of 4 kHz. The light memory, the charging property and the potential shift were measured in the same manner as in Experiment 1.

The results are also contained in Table 1. The charging property is improved, and the potential shift is reduced with the light memory maintained good.

Embodiment 4

The electrophotographic apparatus shown in FIG. 1 was used. The photosensitive member 101 was rotated at a peripheral speed of 380 m/sec. The main charge removing light source 106 was in the form of an LED providing a wavelength peak of 565 nm. The energization of the main charge removing light source 106 was controlled through a pulse width modulation system shown in FIG. 6. The duty ratio was 25%; and the quantity of light was 3 μJ/cm$^2$. Under these conditions, the light memory, the charging property and the potential shift were measured.

In this embodiment, the reference wave had a frequency of 4 kHz. The light memory, the charging property and the potential shift were measured in the same manner as Experiment 1.

The results of experiment are also included in Table 1. The charging property is improved and the potential shift is reduced with the good light memory maintained.

By investigating Table 1 for each of the parameters, the following will be understood.

Table 2 contains the duty dependency parameters extracted. From this table, it will be understood that under the condition of the constant wavelength and the constant quantity of light, the charging property and the potential shift are improved by reducing the duty, and that the light memory is not dependent on the duty.

Table 3 contains data relating to the wavelength dependence extracted from Table 1. From Table 3, it will be understood that under the condition of constant quantity of light and the constant duty, the charging property and the potential shift are improved by reducing the wavelength, but the light memory is worsened thereby.

Finally, Table 4 contains data relating to the light quantity dependency extracted from Table 1. From Table 4, it will be understood under the condition of constant wavelength and the constant duty, the light memory is worsened with decrease of the quantity of light, but the charging property and the potential shift are not influenced significantly.

TABLE 2

| | Wavelength (nm) | Light quantity (μJ/cm$^2$) | Duty ratio | Photo-memory | Charging property & potential shift | Total |
|---|---|---|---|---|---|---|
| Embodiment 1 | 565 | 5 | 25 | ○ | ◎ | ◎ |
| Embodiment 3 | " | " | 50 | ○ | ○ | ○ |
| Comparison Example 1 | " | " | 100 | ○ | Δ | Δ |
| Embodiment 2 | 610 | " | 25 | ◎ | ○ | ◎ |
| Comparison Example 2 | " | " | 100 | ◎ | x | Δ |

◎: Excellent
○: Good
Δ: Fair
x: No good

TABLE 3

| | Wavelength (nm) | Light quantity (μJ/cm²) | Duty ratio | Photo-memory | Charging property & potential shift | Total |
|---|---|---|---|---|---|---|
| Embodiment 1 | 565 | 5 | 25 | ○ | ◎ | ◎ |
| Embodiment 2 | 610 | " | " | ◎ | ○ | ◎ |
| Comparison Example 1 | 565 | " | 100 | ○ | Δ | Δ |
| Comparison Example 2 | 610 | " | " | ◎ | x | Δ |

◎: Excellent
○: Good
Δ: Fair
x: No good

TABLE 4

| | Wavelength (nm) | Light quantity (μJ/cm²) | Duty ratio | Photo-memory | Charging property & potential shift | Total |
|---|---|---|---|---|---|---|
| Embodiment 1 | 565 | 5 | 25 | ○ | ◎ | ◎ |
| Embodiment 4 | " | 3 | " | Δ | ◎ | ○ |

◎: Excellent
○: Good
Δ: Fair
x: No good

Embodiment 5

The electrophotographic apparatus shown in FIG. 1 was used. The photosensitive member 101 was an OPC photosensitive member of copper phthalocyanine type. It was rotated at a speed of 270 mm/sec. The main charge removing light source 106 was in the form of an LED having a wavelength peak of 565 nm. The energization of the main charge removing light source 106 was controlled through a pulse width modulation system shown in FIG. 6. The duty ratio was 50%; and the light quantity was 5 μJ/cm². Under these conditions, the light memory, the charging property and the potential shift were measured.

The reference wave had a frequency of 4 kHz. The light memory, the charging property and the potential shift were measured in the same manner as in Experiment 1.

As a result, it will be understood that the charging property is improved, and the potential shift is reduced with the good light memory maintained.

Embodiment 6

An electrophotographic apparatus shown in FIG. 1 was used. The photosensitive member 101 at Se-Te photosensitive member. It was rotated at a peripheral speed of 270 mm/sec. The main charge removing light source 106 was in the form of an LED having a wavelength peak of 555 nm. The energization of the main charge removing light source 106 was controlled through a pulse width modulation control system shown in FIG. 6. The duty ratio was 50%; and the light quantity was 5 μJ/cm². Under these conditions, the light memory, the charging property and the potential shift were measured.

In this embodiment, the reference wave had a frequency of 4 kHz. The light memory, the charging property and the potential shift were measured in the same manner as in Experiment 1.

As a result, the charging property is improved, and the potential shift is reduced with the good light memory maintained.

As described in the foregoing, in the electrophotographic apparatus of these embodiments, the main charge removing light source is controlled by a pulse width modulation system (PWM), and the pulse exposure is effected with high intensity, and therefore, the light memory reducing capability of the main charge removing light required for the ghost image removal is maximized, and in addition, the deterioration of the charging property and the potential shift are minimized, so that the high quality image can be provided with the good total performance.

The pulse width modulation (PWM) per se is known in an electrophotographic apparatus using a laser beam source as the image exposure beam source, as disclosed in Japanese Laid-Open Patent Application No. 39972/1987, for example. However, the pulse width modulation (PWM) is first used in this invention to control the light quantity of the main charge removing light.

The description will be made another group of embodiments in which the amorphous silicon photosensitive member was used.

Embodiment 7

Figure 10:
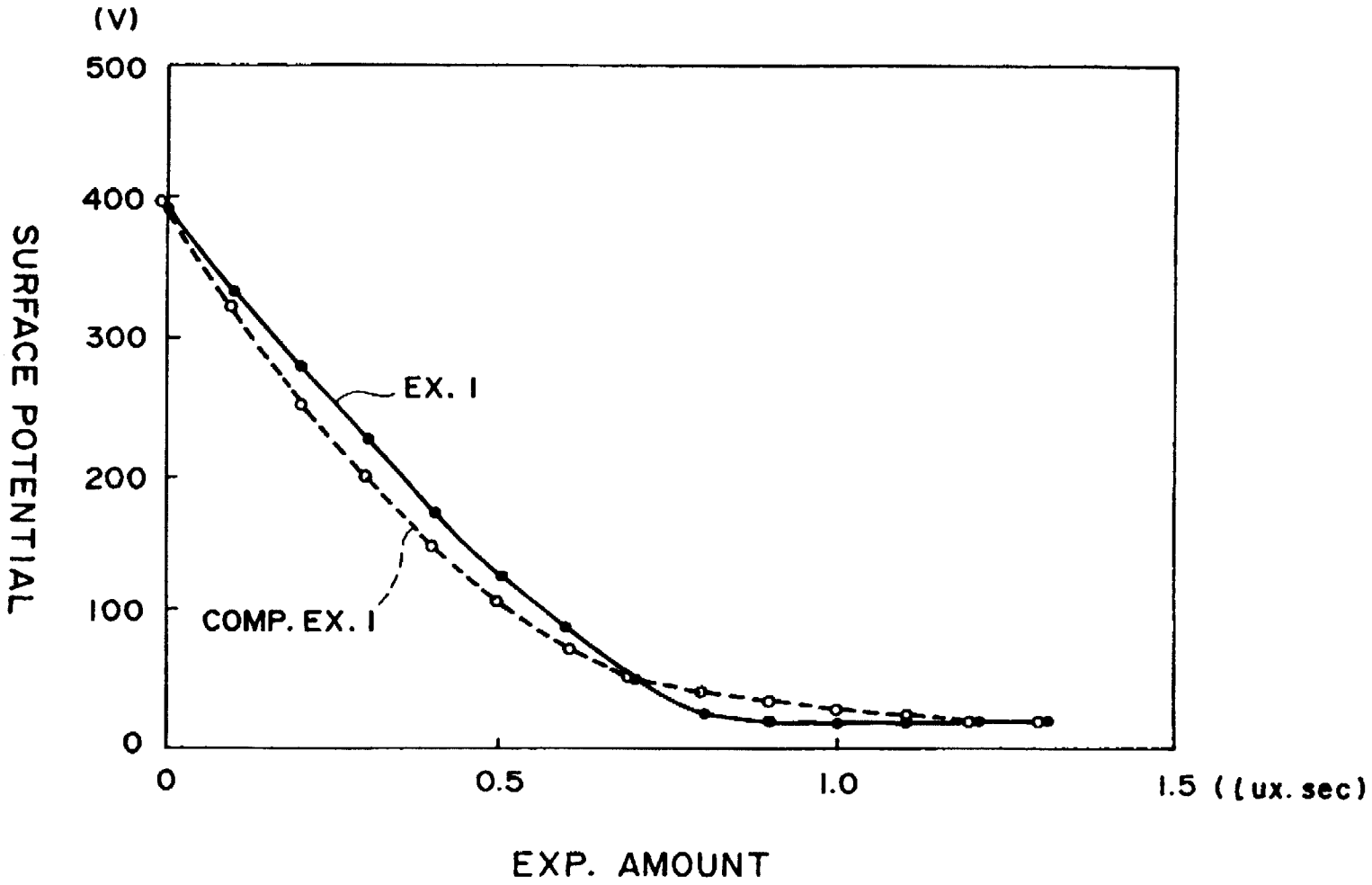
FIG. 10 is a graph of the E-V curve in Example 1 and Comparison Example 1.

The electrophotographic photosensitive member used was an amorphous silicon photosensitive member in the form of a drum. The electrophotographic apparatus used was as shown in FIG. 1. The photosensitive member 101 was rotated at the surface peripheral speed of 380 mm/sec. The main charge removing light source 106 in the form of an LED array providing 565 nm was controlled through a pulse width modulation system shown in FIGS. 6 and 7. The light quantity was 5 μJ/cm². The dependency of the surface potential on the exposure amount (E-V curve) was determined. The results of experiments are shown in FIG. 10. The determination of the E-V curve was as follows.

The charging current of the main charger 102 is adjusted so that the dark potential at the developing position is 400 V. Then, the actuating voltage of the original illuminating halogen lamp 114 for the image exposure is changed using an original 117 of a copy sheet (A3 size) P, and the light potential is measured for each light quantity, and the E-V curve is determined on the basis of the measurements.

Comparison Example 7

Using the same electrophotographic apparatus as in Experiment 1, the photosensitive member 101 was rotated at a peripheral speed of 380 mm/sec. The same main charge removing light source 106 was controlled through a conventional DC system as shown in FIG. 8. The quantity of the light was 5 $\mu J/cm^2$. Under these conditions, the E-V curve was determined. The E-V curve was determined in the same manner as in Embodiment 7. The results of Experiments are included in FIG. 10.

From FIG. 10, it is understood that the E-V curve is closer to an ideal line in the case of Embodiment 7 using the pulse width modulation control system for the actuation of the main charge removing light source 106 than in the Comparison Example 7 using the DC control system.

Embodiment 8

Figure 11:
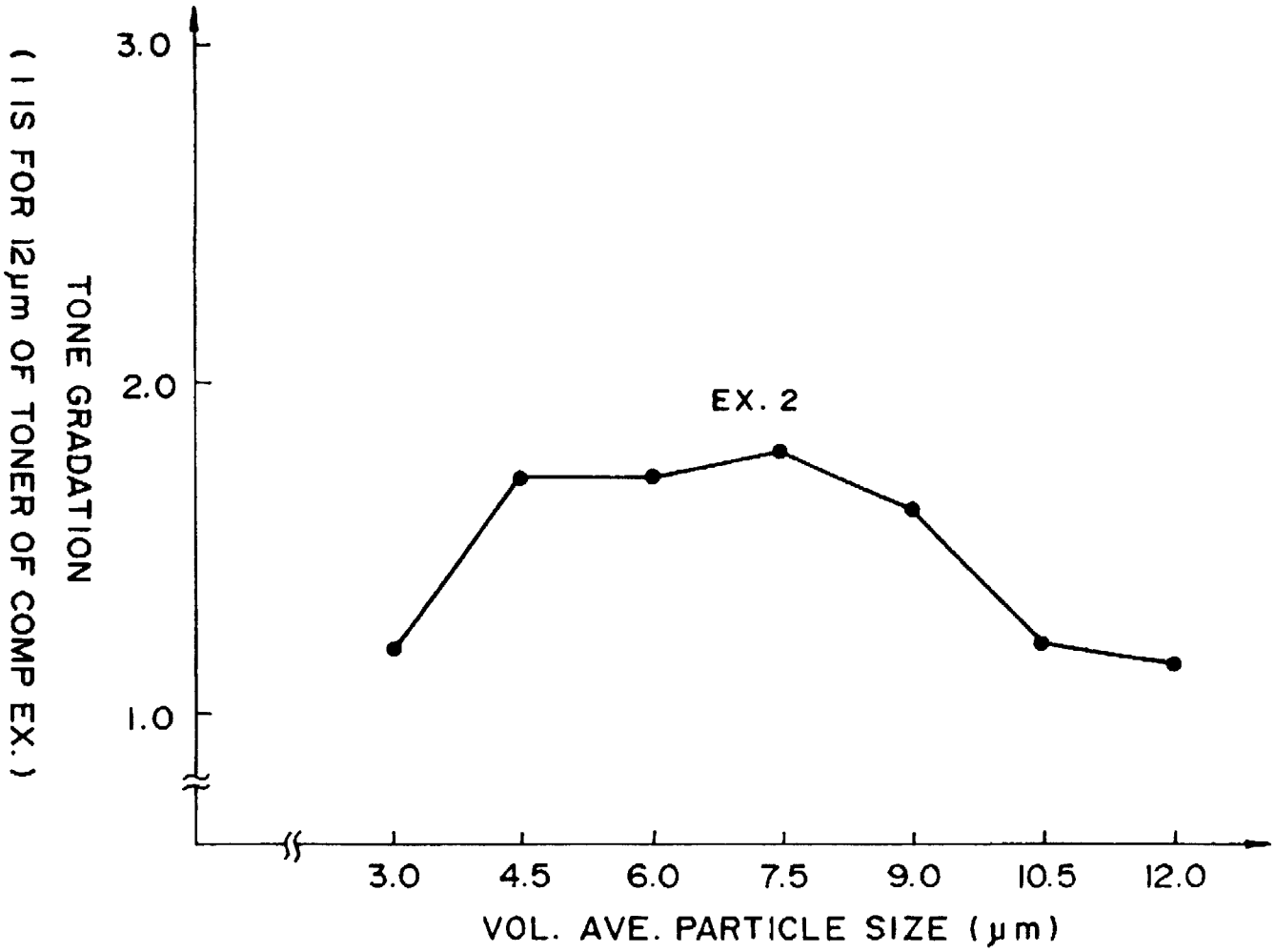
FIG. 11 is a graph of the tone reproducibility in Example 2.

The electrophotographic apparatus used was the same as in Embodiment 7. The photosensitive member 101 was rotated at a peripheral speed of 380 mm/sec. The main charge removing light source 106 in the form of an LED array providing a wavelength of 565 nm, was controlled through a pulse width modulation system shown in FIG. 6. The light quantity was 5 $\mu J/cm^2$. Under these conditions, the dependency of the tone reproducibility on the toner particle size. The results of experiments are shown in FIG. 11.

The evaluation of the tone reproducibility was made in the following manner. As for the original of image formation, a test chart was prepared. The test chart included three black dots having a diameter of 5 mm and a reflection image densities of 0.3, 0.5 and 1.1, respectively. The apparatus was adjusted so that the reflection image densities of the first and the third dots on the copy image are the same as the original, that is 0.3 and 1.1. Under these conditions, the reflection image density on the copy image of the black dot from the original black dot providing the reflection image density of 0.5, was used as the evaluation of the tone reproducibility. More particularly, the absolute value of the difference of the reflection image densities between the test chart and the copy image for the black dot providing the reflection image density of 0.5 on the original.

Comparison Example 8

The same electrophotographic apparatus as in Experiment 2 was used. The photosensitive member 101 was rotated at a peripheral speed of 380 mm/sec. The main charge removing light source 106 in the form of an LED array providing a 565 nm light was controlled through a conventional DC control system shown in FIG. 8. The quantity of light was 5 $\mu J/cm^2$. The dependency of the image reproducibility on the toner particle size was evaluated. The results are contained in FIG. 11. The evaluation of the tone reproducibility was made in the same manner as in Embodiment 8.

In FIG. 11, the ordinate represents a ratio of the value in Embodiment 8 to the value in the image of the Comparison Example 8.

From FIG. 11, it is understood that when the pulse width modulation control system is used for the main charge removing light source, the tone reproducibility is improved when the toner particle size ranges from 4.5–9.0 microns.

The description will be made as to the developer used in the embodiment. As described, the developer contains insulative toner having a volume average particle size of not less than 4.5 microns and not more than 9.0 microns (small particle size toner).

The small particle size toner contained at least binder resin. The usable binder resin materials include, for example, styrene or its substitute polymer such as polystyrene, poly-p-chlorostyrene or polyvinyltoluene; styrene copolymer such as styrene-p-chlorostyrene copolymer, styrene-vinyl toluene copolymer, styrene-vinyl naphthalene copolymer, styrene-acrylic acid ester copolymer, styrene, methacryl acid ester copolymer, styrene-α-chloromethacrylic acid methyl copolymer, styreneacrylnitrilic copolymer, styrene-vinyl methyl ether copolymer, styrene-vinylethyl ether copolymer, styrene-vinylmethyl ketone copolymer, styrene-butadiene copolymer, styrene-isoprene copolymer, styrene-acrylonitrile-indene copolymer; polyvinyl chloride; phenol resin; natural modified phenol resin; natural resin modified malein acid resin; acrylic resin; methacryl resin; polyvinyl acetate resin; silicone resin; polyester resin; polyurethane resin; polyamide resin; furan resin; epoxy resin; xylene resin; polyvinyl butyral resin; terpene resin; chmaron indene resin or petroleum resin.

The small particle size toner is produced by mixing the coloring material into the binder resin. The coloring materials which can be used, include magnetic particles, pigment and dye. The magnetic particles may be of surface oxidized or not oxidized iron, nickel, copper, manganese, chrome, rare earth or another metal or alloy of them, oxide thereof, or ferrite. The pigments include disazo yellow in soluble azo, copper phthalocyanine. The usable dye materials contain basic dye, oil soluble dye. The preferable pigments include C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, C.I. Pigment Blue 16, or a copper phthalocyanine pigment having the following formula with the phthalocyanine frame in which 2–3 benzamide methyl carbonic acid barium are substituted.

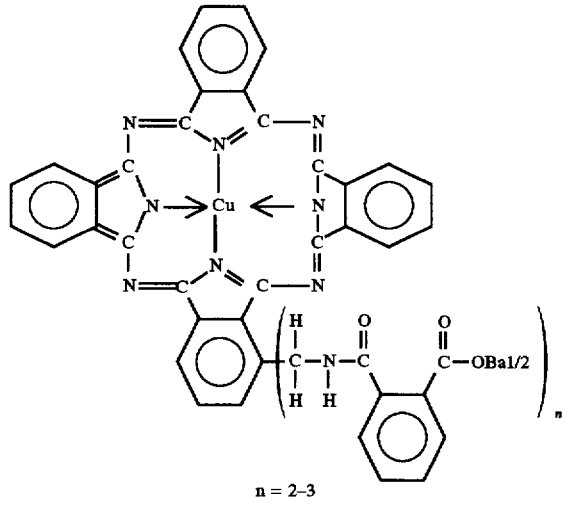

n = 2–3

The usable dye materials include C.I. Solvent Red 49, C.I. Solvent Red 52, C.I. Solvent Red 109, C.I. Basic Red 12, C.I. Basic Red 1, C.I. Basic Red 3b.

The developer may contains charge controlling agent for controlling the charge of the toner, or lubricant for improving the flowability of the toner, or another additives, may be added, as desired.

The small particle size toner may be produced by fusing, kneading, pulverizing the material. In another producing method, the materials are dispersed in the binder resin liquid, and it is atomized and dried. In a further method, the proper materials are mixed into a monomer constituting the binder resin into an emulsion, and it is copolymerized (copolymerization method). In a further method, the proper materials are contained in one or both of the core or shell materials in the case of microcapsule toner constituted by a core material and a shell material.

Some producing methods for the small particle size toner will be described.

EXAMPLE 1

As for the binder resin, 100 parts of styrene/2 ethyl hexyl was prepared. As for the magnetic particles, 60 parts of magnetite was prepared. As for the charge controlling material, 2 parts of nigrosin was prepared; and as for the parting material, 3 parts of polypropylene was prepared. They are preliminary kneaded using Henschel mixer. The mixture was fused and kneaded by a roll mill at the temperature of 160° C. The kneaded material was cooled, and was pulverized by a hammer mill into the size of approximately 1–2 mm. Thereafter, they were further pulverized into 0.1–50 microns by an ultrasonic jet pulverizer.

The finely pulverized materials thus produced, were classified by Microplex 400MP classifier available from Alpine Incorporated so s to cut off the materials having the particle size of not less than 9 microns. Thereafter, the thus classified materials are further classified by Microplex 132MP classifier available from the Alpine Incorporated so as to cut off the materials having the particle size not more than 4.5 microns. Thus, the toner having the volume average particle size of 4.5–9 microns was produced.

EXAMPLE 2

As for the binder resin, 100 parts of styrene butadiene copolymer was prepared; as for the magnetic particles, 65 parts of magnetite; and as for the charge control agent, 2 parts of salicylic acid metal complex was prepared. They are fused and kneaded by an extruder at the temperature of 180° C. In the other respects, the method is the same as in Example 1. In this manner, the toner having the volume average particle size of 4.5–9 microns was produced.

EXAMPLE 3

A binder resin material (100 parts of styrene acrylic resin material) and the magnetic particles (60 parts of MGW available from Mitsui Kinzoku Kogyo Kabushiki Kaisha) are solved in a toluene solvent. The liquid contained 10% of the solid materials. The liquid was subjected to the spray-dry process with the hot air blow of 100° C. and under the pressure of 4 kg/cm$^2$ using Ashizawa Niroatomizer available from Ashizawa Tekkosho Kabushiki Kaisha, Japan. Thus, the microcapsule toner was produced. The grain size of the toner was measured by a Coulter Counter Type II with the aperture size of 100 microns. The particle size was 0.1—several hundreds microns, approximately. The toner was classified using the Microplex 400MP available from Arpine Incorporated, and further by Microplex 132MP classifier available from the same Company through the same classifying step as in Example 1, so as to provide the particle size of 4.5–9 microns.

The embodiments will be further described, but the present invention is not limited to these specific examples.

Embodiment 9

The electrophotographic machine shown in FIG. 1 was used. An evaluating original 117 was placed on the platen glass 118. The photosensitive member 101 was rotated in the direction X at a peripheral speed of 380 mm/sec. The halogen lamp 114 was turned on to illuminate the original 117. The image light 103 reflected by the original 117 is directed onto the surface of the photosensitive member by way of the reflecting mirror 119, the lens system 116 and the filter 115, so that an electrostatic latent image is formed on the surface thereof. The latent image is developed into a toner image with the toner produced in the manner described above, that is an insulating magnetic toner having an average particle size of 5.0. The toner image is transferred onto a transfer sheet P supplied by a transfer material feeding system, by a transfer and separation chargers 112. Then, the transfer sheet P is conveyed to an image fixing device (not shown) through a transfer material conveying system 113, and the image was evaluated.

In this embodiment, the main charge removing light source 106 as an LED having a wavelength peak of 565 nm. The main charge removing light source 106 was controlled through a pulse width modulation system as shown in FIG. 6. The duty ratio (the ratio of the on-duration to the one cycle duration shown in FIG. 7) was 25%, and the light quantity of 5 μJ/cm$^2$. In the pulse width modulation, a reference wave in the form of a saw teeth shown in FIG. 7, for example, was used. The control signal level was compared with the reference wave, and the main charge removing light source 106 is ON-OFF controlled in accordance with the results of the comparison. In this embodiment, the reference wave had a frequency of 4 kHz.

The images provided by such an electrophotographic apparatus was evaluated, and the tone reproducibility was good.

Comparison Example 9

The same electrophotographic apparatus as in Embodiment 9 was used. The control of the main charge removing light source 106 was effected through a DC control system shown in FIG. 8. The light quantity was 5 μJ/cm$^2$ In the other respects the conditions are the same as in Embodiment 9.

The images thus produced were evaluated. The tone reproducibility was the same as in the case of using the conventional toner having the particle size of 10–12 microns. In other words, no advantageous effects were confirmed even if the small particle size toner were used.

Embodiment 10

The same electrophotographic apparatus as in Embodiment 1 was used. The developer was an insulating magnetic toner having a volume average particle size of 7.0 microns. The main charge removing light was controlled in the following manner, and the conditions are the same as in Embodiment 9 in the other respects. As for the main charge removing light source 106, an LED having a wavelength peak of 610 nm was used. The control for the main charge removing light source 106 was effected through a pulse width modulation system shown in FIG. 6 with the duty ratio of 25% and the light quantity of 4 μJ/cm$^2$. The pulse width modulation uses a saw teeth wave as shown in FIG. 7, for example, as the reference wave. The comparison is made between the control signal level and the reference wave, and the main charge removing light source was ON-OFF controlled in accordance with the results of comparison. The reference wave had a frequency of 4 kHz.

The resultant images were evaluated, and the tone reproducibility was satisfactory.

Embodiment 11

The same electrophotographic apparatus as in Embodiment 9 was used. The developer had the average particle size 7.0 microns and was an insulating magnetic toner. The other conditions were the same as in Embodiment 9 with the exception for the main charge removing light, which was as follows.

The main charge removing light source 106 was in the form of an LED having a wavelength peak of 700 nm. The main charge removing light source 106 was controlled through a pulse width modulation system shown in FIG. 6. The duty ratio was 25%, and the light quantity was 3 $\mu J/cm^2$. The pulse width modulation uses a saw teeth wave as shown in FIG. 7, for example, as a reference wave. The control signal level was compared with the reference wave, and the main charge removing light source was ON-OFF controlled in accordance with the result of comparison. In this embodiment, the reference wave had a 4 kHz frequency.

As described in the foregoing, in the electrophotographic apparatus of this embodiment uses a pulse width modulation (PWM) system for the control of the main charge removing light source, and the high intensity pulse exposure is used. Therefore, the ideal E-V linearity can be provided without adverse influence to the other potential characteristics, and the small particle size toner advantages are sufficiently used. Thus, the high tone reproducibility and high quality images can be provided.

Conventionally, the non-uniformity of the halftone potential are produced as it is on the halftone image. According to this invention, the E-V linearly is improved, and the tone reproducibility is improved, and therefore, the non-uniformity of the halftone potential is suppressed, and thus, the non-uniformity on the halftone image can be reduced, unexpectedly.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a photosensitive member including amorphous silicon, movable along an endless path;

charging means for charging said photosensitive member;

optical means for projecting light information onto said photosensitive member to form an electrostatic latent image;

optical charge removing means for removing residual charge from said photosensitive member, said charge removing means having a light source disposed upstream of said charging means with respect to a movement direction of said photosensitive member and actuated through a pulse width modulation system with a reference wave frequency of not more than 10 kHz;

wherein a movement speed (mm/sec) of the photosensitive member divided by said frequency (/sec) is not more than 1 mm.

2. An image forming apparatus, comprising:

a photosensitive member including amorphous silicon, movable along an endless path;

charging means for charging said photosensitive member;

optical means for projecting light information onto said photosensitive member to form an electrostatic latent image;

developing means for developing the latent image with a developer;

optical charge removing means for removing residual charge from said photosensitive member, said charge removing means having a light source disposed upstream of said charging means with respect to a movement direction of said photosensitive member and actuated through a pulse width modulation system with a reference wave frequency of not more than 10 kHz;

wherein a movement speed (mm/sec) of the photosensitive member divided by said frequency (/sec) is not more than 1 mm, wherein the latent image is developed with the developer having a volume average particle size of not less than 4.5 microns and not more than 9.0 microns, and wherein the developer is an insulating magnetic toner.

3. An image forming apparatus, comprising:

an electrophotographic photosensitive member movable along an endless path;

charging means for charging said photosensitive member;

optical means for projecting light information on said photosensitive member to form an electrostatic latent image; and optical charge removing means for removing residual electric charge from said photosensitive member, said optical charge removing means having a light source disposed upstream of said charging means with respect to a movement direction of said photosensitive member and being operated so as to repeat an illuminating state and a non-illuminating state prior to each subsequent latent image formation, wherein a frequency of repetition of the illuminating state and non-illuminating state is not more than 10 Khz.

4. An image forming apparatus comprising:

an electrophotographic photosensitive member;

charging means for charging said photosensitive member;

image exposure means for exposing said photosensitive member charged by said charging means to image-light to form an electrostatic image on the photosensitive member; and optical charge removing means for removing residual electric charge from said photosensitive member, said optical charge removing means being rendered on and off at a predetermined frequency during the removing of the residual electric charge, wherein said photosensitive member is movable at a speed (mm/sec) which is not more than 1 mm when it is divided by the frequency (Hz).

5. An apparatus according to claim 4, wherein said frequency is not more than 10 Khz.

6. An apparatus according to claim 4, wherein said optical charge removing means produces light which is modulated in pulse width.

7. An apparatus according to claim 4, wherein said photosensitive member comprises an amorphous silicon photosensitive layer.

8. An image forming apparatus comprising;

an electrophotographic photosensitive member;

charging means for charging said photosensitive member;

image exposure means for exposing said photosensitive member charged by said charging means to image-light to form an electrostatic image on the photosensitive member;

developing means for developing the electrostatic image;

transfer means for transferring a developed image from said photosensitive member; and optical charge removing means for removing residual electric charge from said photosensitive member after image transfer by said transfer means and before charging by said charging means, said optical charge removing means being rendered on and off at a predetermined frequency during the removing of the residual electric charge.

9. An apparatus according to claim 8, wherein said photosensitive member is movable at a speed (mm/sec) which is not more than 1 mm when it is divided by the frequency (Hz).

10. An apparatus according to claim 8, wherein said frequency is not more than 10 Khz.

11. An apparatus according to claim 8, wherein said optical charge removing means produces light which is modulated in pulse width.

12. An apparatus according to claim 8, wherein said photosensitive member comprises an amorphous silicon photosensitive layer.

* * * * *

UNITED STATES PATENT AND TRADEMARK OFFICE

CERTIFICATE OF CORRECTION

PATENT NO. : 5,631,727

DATED : May 20, 1997

INVENTOR(S) : Toshiyuki Ehara, et al.

It is certified that error appears in the above-indentified patent and that said Letters Patent is hereby corrected as shown below:

COLUMN 1

Line 29, "massproduction" should read --mass-production--; and
Line 34, "or" should be deleted.

COLUMN 3

Line 53, "100" should read --100 microns,--.

COLUMN 11

Line 51, "101 at Se-Te" should read --101 was a Se-Te--.

COLUMN 14

Line 31, "The" should start a new paragraph.

Signed and Sealed this

Fourteenth Day of October, 1997

Bruce Lehman

*Attest:*

BRUCE LEHMAN

*Attesting Officer*

*Commissioner of Patents and Trademarks*